US006592748B2

(12) United States Patent
Cody et al.

(10) Patent No.: US 6,592,748 B2
(45) **Date of Patent: *Jul. 15, 2003**

(54) REFFINATE HYDROCONVERSION PROCESS

(75) Inventors: Ian A. Cody, Baton Rouge, LA (US); William J. Murphy, Baton Rouge, LA (US); John E. Gallagher, Califon, NJ (US); Joseph P. Boyle, Baton Rouge, LA (US); Anne M. Zinicola, Houston, TX (US); Christopher J. May, Sarnia (CA); Jeenok T. Kim, Morganville, NJ (US); John A. Groestch, Front Royal, VA (US); Sylvain S. Hantzer, Prairieville, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/892,384

(22) Filed: Jun. 26, 2001

(65) Prior Publication Data

US 2002/0038777 A1 Apr. 4, 2002

Related U.S. Application Data

(60) Continuation-in-part of application No. 09/737,008, filed on Dec. 14, 2000, now abandoned, which is a continuation-in-part of application No. 09/531,733, filed on Mar. 21, 2000, now Pat. No. 6,325,918, which is a continuation-in-part of application No. 09/318,074, filed on May 25, 1999, now abandoned, which is a division of application No. 08/678, 382, filed on Jun. 28, 1996, now Pat. No. 5,976,353.

(51) Int. Cl.[7] ..... C10G 73/02; C10G 73/06; C10G 1/04

(52) U.S. Cl. ..... 208/87; 208/18; 208/27; 208/28; 208/33; 208/86; 208/133

(58) Field of Search ..... 208/18, 27, 28, 208/33, 86, 87, 133

(56) References Cited

U.S. PATENT DOCUMENTS

| | | | | |
|---|---|---|---|---|
| 3,155,608 | A | 11/1964 | Hopper et al. | 208/251 |
| 3,691,067 | A | 9/1972 | Ashton et al. | 208/264 |
| 3,732,154 | A | 5/1973 | Mills et al. | 208/87 |

(List continued on next page.)

FOREIGN PATENT DOCUMENTS

| | | | |
|---|---|---|---|
| EP | 0471524 A1 | 2/1992 | C10G/65/04 |
| EP | 0649896 A1 | 4/1995 | C10G/65/12 |
| GB | 1240913 | 7/1971 | C10G/31/14 |
| GB | 1546504 | 5/1979 | C10G/23/02 |
| GB | 2059433 | 4/1981 | C10G/67/14 |
| GB | 2001339 B | 2/1982 | C10G/65/04 |

OTHER PUBLICATIONS

S. Bull & A. Marmin, *Lube Oil Manufacture by Severe Hydrotreatment*, 1979, Proceedings of the Tenth World Petroleum Congress, vol. 4, pp. 221–228.

A.S. Galiano–Roth & N.M. Page, *Effect of Hydroprocessing on Lubricant Base Stock Composition and Product Performance*, 08/94, Journal of the Society of Tribologists and Lubrication Engineers, vol. 50, 8, pp. 659–664.

A.K. Rhodes, *Refinery Operating Variables Key to Enhanced Lube Oil Quality*, Oil and Gas Journal, Jan. 4, 19993, pp. 45–49.

(List continued on next page.)

*Primary Examiner*—Walter D. Griffin
*Assistant Examiner*—Tam M. Nguyen
(74) *Attorney, Agent, or Firm*—Jeremy J. Kliebert

(57) ABSTRACT

A process for producing a high VI/low volatility lubricating oil basestock and a lubricating oil basestock prepared by said process. The process comprises subjecting the raffinate from a solvent extraction step to a two step, single stage hydroconversion process wherein the first step involves severe hydroconversion of the raffinate followed by a cold hydrofinishing step.

24 Claims, 7 Drawing Sheets

U.S. PATENT DOCUMENTS

| | | | | |
|---|---|---|---|---|
| 3,779,896 | A | 12/1973 | Woodle | 208/86 |
| 3,926,777 | A | 12/1975 | Menzl | 208/57 |
| 3,929,616 | A | 12/1975 | Meade et al. | 208/87 |
| 4,081,352 | A | 3/1978 | West et al. | 208/36 |
| 4,304,660 | A | 12/1981 | Sequeira, Jr. et al. | 208/326 |
| 4,311,583 | A | 1/1982 | Woodle | 208/312 |
| 4,383,913 | A | 5/1983 | Powell et al. | 208/59 |
| 4,622,129 | A | 11/1986 | Bayle et al. | 208/87 |
| 4,627,908 | A | 12/1986 | Miller | 208/58 |
| 4,636,299 | A | 1/1987 | Unmuth et al. | 208/87 |
| 4,764,265 | A | 8/1988 | Bijwaard et al. | 208/18 |
| 4,849,093 | A | 7/1989 | Vauk et al. | 208/143 |
| 4,853,104 | A | 8/1989 | Degnan, Jr. et al. | 208/61 |
| 4,906,350 | A | 3/1990 | Lucien et al. | 208/197 |
| 4,911,821 | A | 3/1990 | Katzer et al. | 208/27 |
| 5,013,422 | A | 5/1991 | Absil et al. | 208/27 |
| 5,039,399 | A | 8/1991 | Sequeira, Jr. | 208/311 |
| 5,110,445 | A | 5/1992 | Chen et al. | 208/96 |
| 5,171,426 | A | 12/1992 | Mead et al. | 208/322 |
| 5,178,750 | A | 1/1993 | Mead | 208/309 |
| 5,242,579 | A | 9/1993 | Mead et al. | 208/312 |
| 5,273,645 | A | 12/1993 | Clark et al. | 208/87 |
| 5,275,718 | A | 1/1994 | Copeland et al. | 208/12 |
| 5,292,426 | A | 3/1994 | Holland et al. | 208/111 |
| 5,300,213 | A | 4/1994 | Bartilucci et al. | 208/87 |
| 5,302,279 | A | 4/1994 | Degnan et al. | 208/87 |
| 5,393,408 | A | 2/1995 | Ziemer et al. | 208/57 |
| 5,616,238 | A | 4/1997 | Boyle et al. | 208/314 |
| 5,855,767 | A | 1/1999 | Powers et al. | 208/143 |
| 5,911,874 | A | 6/1999 | Cody et al. | 208/87 |
| 5,935,416 | A | 8/1999 | Cody et al. | 208/87 |
| 5,935,417 | A | 8/1999 | Cody et al. | 208/87 |
| 5,976,353 | A | 11/1999 | Cody et al. | 208/87 |
| 5,993,644 | A | 11/1999 | Xiao et al. | 208/89 |
| 6,096,189 | A | 8/2000 | Cody et al. | 208/87 |
| 6,099,719 | A | 8/2000 | Cody et al. | 208/87 |

OTHER PUBLICATIONS

M. Ushio et al., *Production of High VI Base Oil by VGO Deep Hyrdocracking*, presented before the American Chemical Society, Washington, D.C., 08/23–28/92, pp. 1293–1302.

A. Sequeira, *An Overview of Lube Base Oil Processing*, presented before the American Chemical Society, Washington, D.C., 08/23–28/92, pp. 1286–1292.

REFFINATE HYDROCONVERSION PROCESS

CROSS-REFERENCE TO RELATED APPLICATION

This is a continuation-in-part of U.S. Ser. No. 09/737,008 filed Dec. 14, 2000, now abandoned, which is a continuation-in-part of U.S. Ser. No. 09/531,733 filed Mar 21, 2000, now U.S. Pat No. 6,325,918, which is a divisional of U.S. Ser. No. 09/318,074 filed May 25, 1999, now abandoned, which is a divisional of U.S. patent application Ser. No. 08/678,382 filed on Jun. 28, 1996, now U.S. Pat. No. 5,976,353.

FIELD OF THE INVENTION

This invention relates to lubricating oil basestocks and to a process for preparing lubricating oil basestocks having high viscosity indices and low volatilities.

BACKGROUND OF THE INVENTION

It is well known to produce lubricating oil basestocks by solvent refining. In the conventional process, crude oils are fractionated under atmospheric pressure to produce atmospheric resids which are further fractionated under vacuum. Select distillate fractions are then optionally deasphalted and solvent extracted to produce a paraffin rich raffinate and an aromatics rich extract. The raffinate is then dewaxed to produce a dewaxed oil which is usually hydrofinished to improve stability and remove color bodies.

Solvent refining is a process which selectively isolates components of crude oils having desirable properties for lubricant basestocks. Thus the crude oils used for solvent refining are restricted to those which are highly paraffinic in nature as aromatics tend to have lower viscosity indices (VI), and are therefore less desirable in lubricating oil basestocks. Also, certain types of aromatic compounds can result in unfavorable toxicity characteristics. Solvent refining can produce lubricating oil basestocks have a VI of about 95 in good yields.

Today more severe operating conditions for automobile engines have resulted in demands for basestocks with lower volatilities (while retaining low viscosities) and lower pour points. These improvements can only be achieved with basestocks of more isoparaffinic character, i.e., those with VI's of 105 or greater. Solvent refining alone cannot economically produce basestocks having a VI of 105 with typical crudes. Two alternative approaches have been developed to produce high quality lubricating oil basestocks; (1) wax isomerization and (2) hydrocracking. Both of the methods involve high capital investments and suffer from yield debits. Moreover, hydrocracking eliminates some of the solvency properties of basestocks produced by traditional solvent refining techniques. Also, the typically low quality feedstocks used in hydrocracking, and the consequent severe conditions required to achieve the desired viscometric and volatility properties can result in the formation of undesirable (toxic) species. These species are formed in sufficient concentration that a further processing step such as extraction is needed to achieve a non-toxic base stock.

An article by S. Bull and A. Marmin entitled "Lube Oil Manufacture by Severe Hydrotreatment", *Proceedings of the Tenth World Petroleum Congress, Volume* 4, *Developments in Lubrication, PD* 19(2), pages 221–228, describes a process wherein the extraction unit in solvent refining is replaced by a hydrotreater.

U.S. Pat. No. 3,691,067 describes a process for producing a medium and high VI oil by hydrotreating a narrow cut lube feedstock. The hydrotreating step involves a single hydrotreating zone. U.S. Pat. No. 3,732,154 discloses hydrofinishing the extract or raffinate from a solvent extraction process. The feed to the hydrofinishing step is derived from a highly aromatic source such as a naphthenic distillate. U.S. Pat. No. 4,627,908 relates to a process for improving the bulk oxidation stability and storage stability of lube oil basestocks derived from hydrocracked bright stock. The process involves hydrodenitrification of a hydrocracked bright stock followed by hydrofinishing.

It would be desirable to supplement the conventional solvent refining process so as to produce high VI, low volatility oils which have excellent toxicity, oxidative and thermal stability, solvency, fuel economy and cold start properties without incurring any significant yield debit which process requires much lower investment costs than competing technologies such as hydrocracking.

SUMMARY OF THE INVENTION

This invention relates to a process for producing a lubricating oil basestock which comprises:

(a) conducting a lubricating oil feedstock to a solvent extraction zone and under-extracting the feedstock to form an under-extracted raffinate wherein the extraction zone solvent contains water added in the amount from about 1 to about 10 vol. %, based on extraction solvent, such that the extraction solvent contains from 3 to 10 vol. % water;

(b) stripping the under-extracted raffinate of solvent to produce an under-extracted raffinate feed having a dewaxed oil viscosity index from about 75 to about 105;

(c) passing the raffinate feed to a first hydroconversion zone and processing the raffinate feed in the presence of a non-acidic catalyst at a temperature of from about 320 to about 420° C., a hydrogen partial pressure of from about 800 to about 2500 psig (5.6 to 17.3 mPa), space velocity of about 0.2 to about 5.0 LHSV, and a hydrogen to feed ratio of from about 500 to about 5000 Scf/B (89 to 890 $m^3/m^3$) to produce a first hydroconverted raffinate; and (d) passing the first hydroconverted raffinate to a second reaction zone and conducting cold hydrofinishing of the first hydroconverted raffinate in the presence of a hydrofinishing catalyst at a temperature of from about 200 to about 360° C., a hydrogen partial pressure of from about 800 to about 2500 psig (5.6 to 17.3 mPa), a space velocity of from about 1 to about 10 LHSV, and a hydrogen to feed ratio of from about 500 to about 5000 Scf/B (89 to 890 $m^3/m^3$) to produce a hydrofinished raffinate.

The basestocks produced by the process according to the invention have excellent low volatility properties for a given viscosity thereby meeting future industry engine oil standards while achieving good solvency, cold start, fuel economy, oxidation stability and thermal stability properties. In addition, toxicity tests show that the basestock has excellent toxicological properties as measured by tests such as the FDA(c) test.

DETAILED DESCRIPTION OF THE INVENTION

Figure 1:
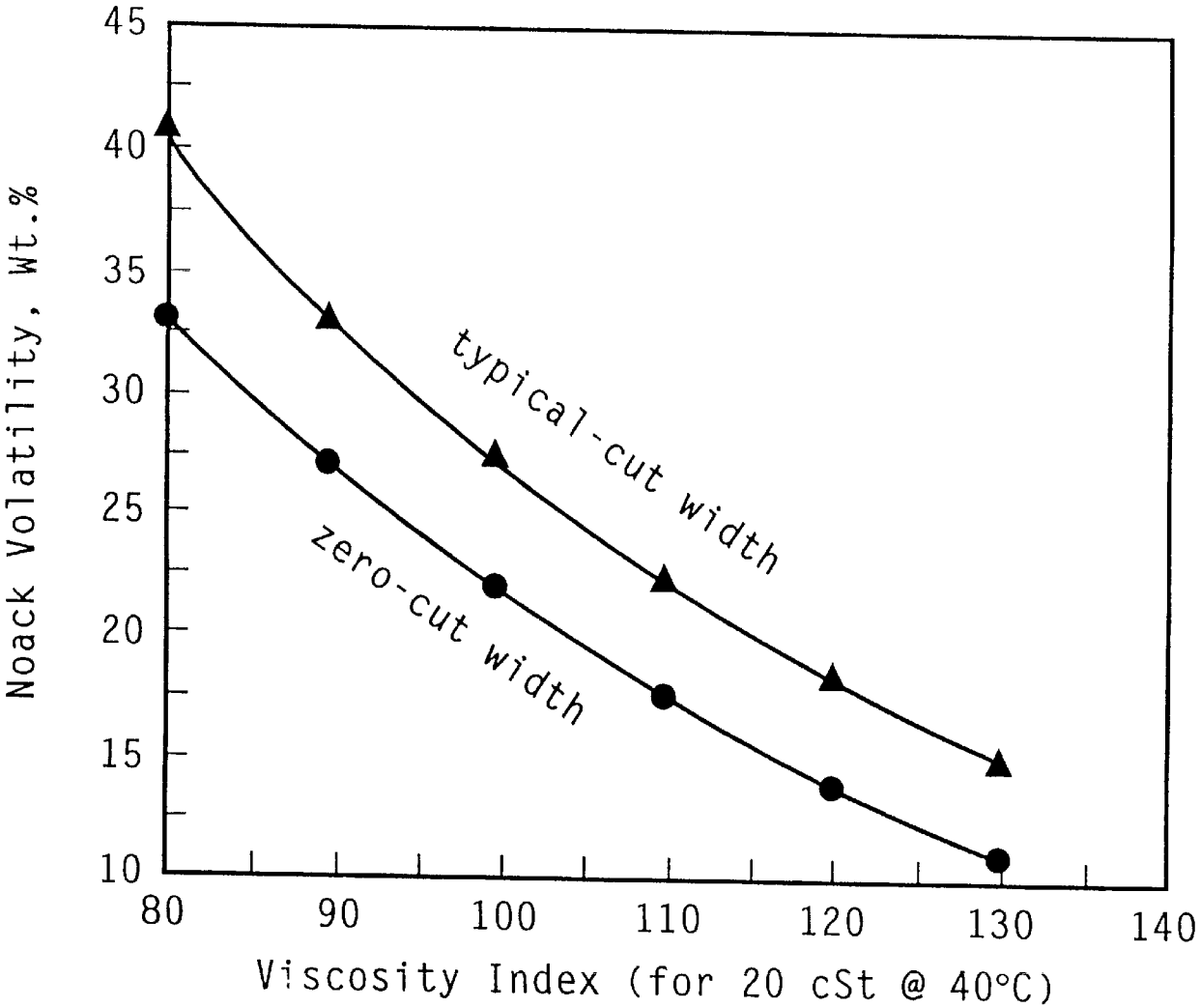
FIG. 1 is a plot of NOACK volatility vs. viscosity index for a 100 N basestock.

The solvent refining of select crude oils to produce lubricating oil basestocks typically involves atmospheric distillation, vacuum distillation, extraction, dewaxing and hydrofinishing. Because basestocks having a high isoparaffin content are characterized by having good viscosity index (VI) properties and suitable low temperature properties, the crude oils used in the solvent refining process are typically paraffinic crudes. One method of classifying lubricating oil basestocks is that used by the American Petroleum Institute (API). API Group II basestocks have a saturates content of 90 wt. % or greater, a sulfur content of not more than 0.03 wt. % and a viscosity index (VI) greater than 80 but less than 120. API Group III basestocks are the same as Group II basestocks except that the VI is greater than or equal to 120.

Generally, the high boiling petroleum fractions from atmospheric distillation are sent to a vacuum distillation unit, and the distillation fractions from this unit are solvent extracted. The residue from vacuum distillation which may be deasphalted is sent to other processing.

The solvent extraction process selectively dissolves the aromatic components in an extract phase while leaving the more paraffinic components in a raffinate phase. Naphthenes are distributed between the extract and raffinate phases. Typical solvents for solvent extraction include phenol, furfural and N-methyl pyrrolidone. By controlling the solvent to oil ratio, extraction temperature and method of contacting distillate to be extracted with solvent, one can control the degree of separation between the extract and raffinate phases.

In recent years, solvent extraction has been replaced by hydrocracking as a means for producing high VI basestocks in some refineries. The hydrocracking process utilizes low quality feeds such as feed distillate from the vacuum distillation unit or other refinery streams such as vacuum gas oils and coker gas oils. The catalysts used in hydrocracking are typically sulfides of Ni, Mo, Co and W on an acidic support such as silica/alumina or alumina containing an acidic promoter such as fluorine. Some hydrocracking catalysts also contain highly acidic zeolites. The hydrocracking process may involve hetero-atom removal, aromatic ring saturation, dealkylation of aromatics rings, ring opening, straight chain and side-chain cracking, and wax isomerization depending on operating conditions. In view of these reactions, separation of the aromatics rich phase that occurs in solvent extraction is an unnecessary step since hydrocracking can reduce aromatics content to very low levels.

By way of contrast, the process of the present invention utilizes a two step hydroconversion of the raffinate from the solvent extraction unit under conditions which minimizes hydrocracking and hydroisomerization while maintaining a residual aromatics content consistent with the objective of high saturates.

The distillate feeds to the extraction zone are from a vacuum or atmospheric distillation unit, preferably from a vacuum distillation unit and may be of poor quality. The feeds may contain nitrogen and sulfur contaminants in excess of 1 wt. % based on feed.

The raffinate from the solvent extraction is preferably under-extracted, i.e., the extraction is carried out under conditions such that the raffinate yield is maximized while still removing most of the lowest quality molecules from the feed. Raffinate yield may be maximized by controlling extraction conditions, for example, by lowering the solvent to oil treat ratio and/or decreasing the extraction temperature. The raffinate from the solvent extraction unit is stripped of solvent and then sent to a first hydroconversion unit (zone) containing a hydroconversion catalyst. This raffinate feed to the first hydroconversion unit is extracted to a dewaxed oil viscosity index of from about 75 to about 105, preferably about 80 to 95.

In carrying out the extraction process, water may be added to the extraction solvent in amounts ranging from 1 to 10 vol. % such that the extraction solvent to the extraction tower contains from 3–10 vol. % water, preferably 4 to 7 vol. % water. In general, feed to the extraction tower is added at the bottom of the tower and extraction/water solvent mixture added at the top and the feed and extraction solvent contacted in counter-current flow. The extraction solvent containing added water may be injected at different levels if the extraction tower contains multiple trays for solvent extraction. The use of added water in the extraction solvent permits the use of low quality feeds while maximizing the paraffin content of the raffinate and the 3+ multi-ring compounds content of the extract. Solvent extraction conditions include a solvent to oil ratio of from 0.5 to 5.0, preferably 1 to 3 and extraction temperatures of from 40 to 120° C., preferably 50 to 100° C.

If desired, the raffinate feed may be solvent dewaxed under solvent dewaxing conditions prior to entering the first hydroconversion zone. It may be advantageous to remove wax from the feed since very little, if any wax is converted in the hydroconversion units. This may assist in debottlenecking the hydroconversion units if throughput is a problem.

Hydroconversion catalysts are those containing Group VIB metals (based on the Periodic Table published by Fisher Scientific), and non-noble Group VIII metals, i.e., iron, cobalt and nickel and mixtures thereof. These metals or mixtures of metals are typically present as oxides or sulfides on refractory metal oxide supports. Examples of Group VIB metals include molybdenum and tungsten. Other suitable hydrotreating catalysts include bulk metal catalysts such as those containing 30 wt. % or more metals (as metal oxides), based on catalyst, preferably greater than 40 wt. %, more preferably greater than 50 wt. % of metals, based on catalyst wherein the metals include at least one Group VIB or Group VIII metal.

It is preferred that the metal oxide support be non-acidic so as to control cracking. A useful scale of acidity for catalysts is based on the isomerization of 2-methyl-2-pentene as described by Kramer and McVicker, *J. Catalysis,* 92, 355(1985). In this scale of acidity, 2-methyl-2-pentene is subjected to the catalyst to be evaluated at a fixed temperature, typically 200° C. In the presence of catalyst sites, 2-methyl-2-pentene forms a carbonium ion. The isomerization pathway of the carbonium ion is indicative of the acidity of active sites in the catalyst. Thus weakly acidic sites form 4-methyl-2-pentene whereas strongly acidic sites result in a skeletal rearrangement to 3-methyl-2-pentene with very strongly acid sites forming 2,3-dimethyl-2-butene. The mole ratio of 3-methyl-2-pentene to 4-methyl-2-pentene can be correlated to a scale of acidity. This acidity scale ranges from 0.0 to 4.0. Very weakly acidic sites will have values near 0.0 whereas very strongly acidic sites will have values approaching 4.0. The catalysts useful in the present process have acidity values of less than about 0.5, preferably less than about 0.3. The acidity of metal oxide supports can be controlled by adding promoters and/or dopants, or by controlling the nature of the metal oxide support, e.g., by controlling the amount of silica incorporated into a silica-alumina support. Examples of promoters and/or dopants include halogen, especially fluorine, phosphorus, boron, yttria, rare-earth oxides and magnesia. Promoters such as halogens generally increase the acidity of metal oxide supports while mildly basic dopants such as yttria or magnesia tend to decrease the acidity of such supports.

Suitable metal oxide supports include low acidic oxides such as silica, alumina or titania, preferably alumina. Preferred aluminas are porous aluminas such as gamma or eta having average pore sizes from 50 to 200 Å, preferably 75 to 150 Å, a surface area from 100 to 300 $m^2/g$, preferably 150 to 250 $m^2/g$ and a pore volume of from 0.25 to 1.0 $cm^3/g$, preferably 0.35 to 0.8 $cm^3/g$. The supports are preferably not promoted with a halogen such as fluorine as this greatly increases the acidity of the support.

Preferred metal catalysts include cobalt/molybdenum (1–5% Co as oxide, 10–25% Mo as oxide) nickel/molybdenum (1–5% Ni as oxide, 10–25% Co as oxide) or nickel/tungsten (1–5% Ni as oxide, 10–30% W as oxide) on alumina. Especially preferred are nickel/molybdenum catalysts such as KF-840.

Hydroconversion conditions in the first hydroconversion unit include a temperature of from 320 to 420° C., preferably 340 to 400° C., a hydrogen partial pressure of 800 to 2500 psig (5.6 to 17.3 MPa), preferably 800 to 2000 psig (5.6 to 13.9 MPa), a space velocity of from 0.2 to 5.0 LHSV, preferably 0.3 to 3.0 LHSV and a hydrogen to feed ratio of from 500 to 5000 Scf/B (89 to 890 $m^3/m^3$), preferably 2000 to 4000 Scf/B (356 to 712 $m^3/m^3$).

The hydroconverted raffinate from the first reactor is then conducted to a second reactor where it is subjected to a cold (mild) hydrofinishing step. The catalyst in this second reactor may be the same as those described above for the first reactor. However, more acidic catalyst supports such as silica-alumina, zirconia and the like may be used in the second reactor. Catalysts may also include Group VIII noble metals, preferably Pt, Pd or mixtures thereof on a metal oxide support which may be promoted. The catalyst and hydroconverted raffinate may be contacted in counter-current flow.

Conditions in the second reactor include temperatures of from 200 to 360, preferably 290 to 350, a hydrogen partial pressure of from 800 to 2500 psig (5.5 to 17.3 MPa), preferably 800 to 2000 psig (5.5 to 13.9 MPa), a space velocity of from 0.2 to 10 LHSV, preferably 0.7 to 3 LHSV and a hydrogen to feed ratio of from 500 to 5000 Scf/B (89 to 890 $m^3/m^3$), preferably 2000 to 4000 Scf/B (356 to 712 $m^3m^3$).

In order to prepare a finished basestock, the hydroconverted raffinate from the second reactor may be conducted to a separator, e.g., a vacuum stripper (or fractionator) to separate out low boiling products. Such products may include hydrogen sulfide and ammonia formed in the first reactor. If desired, a stripper may be situated between the first and second reactors, but this is not essential to produce basestocks according to the invention. If a stripper is situated between the hydroconversion unit and the hydrofinishing unit, then the stripper may be followed by at least one of catalytic dewaxing and solvent dewaxing.

The hydroconverted raffinate separated from the separator is then conducted to a dewaxing unit. Dewaxing may be accomplished by catalytic processes under catalytic dewaxing conditions, by solvent dewaxing under solvent dewaxing conditions using a solvent to dilute the hydrofinished raffinate and chilling to crystallize and separate wax molecules, or by a combination of solvent dewaxing and catalytic dewaxing. Typical solvents include propane and ketones. Preferred ketones include methyl ethyl ketone, methyl isobutyl ketone and mixtures thereof. Dewaxing catalysts are molecular sieves, preferably 10 ring molecular sieves, especially unidimensional 10 ring molecular sieves. Preferred molecular sieves include ZSM-5, ZSM-22, ZSM-23, ZSM-35, ZSM-48, ZSM-57, MCM-22, SAPO-11, SAPO-41 and isostructural molecular sieves.

If a dewaxing catalyst is employed which is tolerant of low boiling products containing nitrogen or sulfur, it may be possible to by-pass the separator and conduct the hydroconverted raffinate directly to a catalytic dewaxing unit and subsequently to a hydrofinishing zone.

In another embodiment, the dewaxing catalyst may be included within the hydroconversion unit following the hydroconversion catalyst. In this stacked bed configuration, the hydroconverted raffinate in the hydroconversion zone is contacted with the dewaxing catalyst situated within the hydroconversion zone and after the hydroconversion catalyst.

The solvent/hydroconverted raffinate mixture may be cooled in a refrigeration system containing a scraped-surface chiller. Wax separated in the chiller is sent to a separating unit such as a rotary filter to separate wax from oil. The dewaxed oil is suitable as a lubricating oil basestock. If desired, the dewaxed oil may be subjected to catalytic isomerization/dewaxing to further lower the pour point. Separated wax may be used as such for wax coatings, candles and the like or may be sent to an isomerization unit.

The lubricating oil basestock produced by the process according to the invention is characterized by the following properties: viscosity index of at least about 105, preferably at least 107, NOACK volatility improvement (as measured by DIN 51581) over raffinate feedstock of at least about 3 wt. %, preferably at least about 5 wt. %, at the same viscosity within the range 3.5 to 6.5 cSt viscosity at 100° C., pour point of −15° C. or lower, and a low toxicity as determined by IP346 or phase 1 of FDA (c). IP346 is a measure of polycyclic aromatic compounds. Many of these compounds are carcinogens or suspected carcinogens, especially those with so-called bay regions [see *Accounts Chem. Res.* 17, 332(1984) for further details]. The present process reduces these polycyclic aromatic compounds to such levels as to pass carcinogenicity tests even though the lubricating oil may contain a small amount of residual aromatics content. The FDA (c) test is set forth in 21 CFR 178.3620 and is based on ultraviolet absorbances in the 300 to 359 nm range.

As can be seen from FIG. 1, NOACK volatility is related to VI for any given basestock. The relationship shown in FIG. 1 is for a light basestock (about 100N). If the goal is to meet a 22 wt. % NOACK for a 10 N oil, then the oil should have a VI of about 110 for a product with typical-cut width, e.g., 5 to 50% off by GCD at 60° C. Volatility improvements can be achieved with lower VI product by decreasing the cut width. In the limit set by zero cut width, one can meet 22% NOACK at a VI of about 100. However, this approach, using distillation alone, incurs significant yield debits.

Hydrocracking is also capable of producing high VI, and consequently low NOACK basestocks, but is less selective (lower yields) than the process of the invention. Furthermore both hydrocracking and processes such as wax isomerization destroy most of the molecular species responsible for the solvency properties of solvent refined oils. The latter also uses wax as a feedstock whereas the present process is designed to preserve wax as a product and does little, if any, wax conversion.

Figure 2:
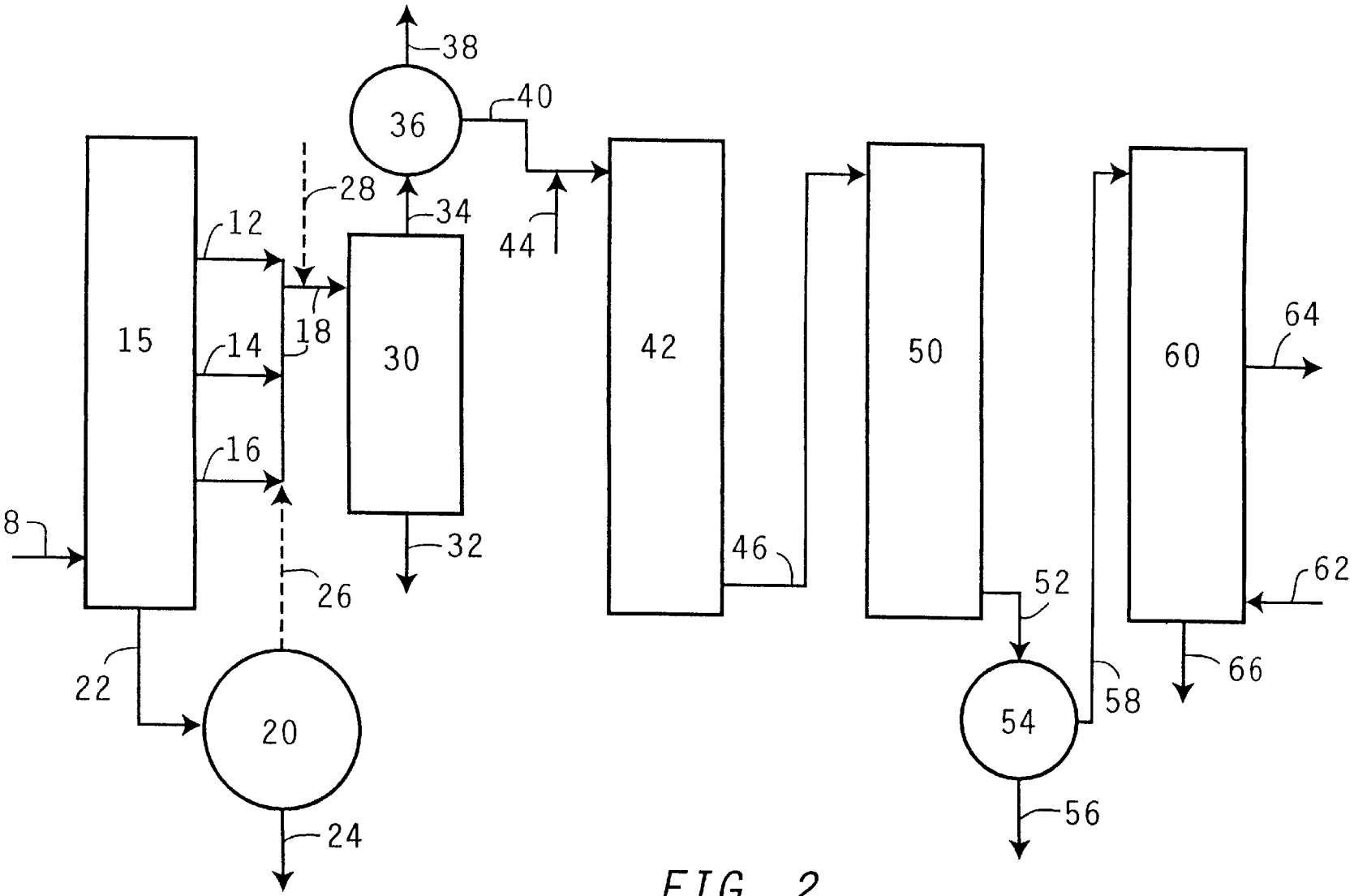
FIG. 2 is a simplified schematic flow diagram of the raffinate hydroconversion process.

The process of the invention is further illustrated by FIG. 2. The feed 8 to vacuum pipestill 10 is typically an atmospheric reduced crude from an atmospheric pipestill (not shown). Various distillate cuts shown as 12 (light), 14 (medium) and 16 (heavy) may be sent to solvent extraction unit 30 via line 18. These distillate cuts may range from about 200° C. to about 600° C. The bottoms from vacuum pipestill 10 may be sent through line 22 to a coker, a visbreaker or a deasphalting extraction unit 20 where the bottoms are contacted with a deasphalting solvent such as propane, butane or pentane. The deasphalted oil may be combined with distillate from the vacuum pipestill 10 through line 26 provided that the deasphalted oil has a boiling point no greater than about 600° C. or is preferably sent on for further processing through line 24. The bottoms from deasphalter 20 can be sent to a visbreaker or used for asphalt production. Other refinery streams may also be added to the feed to the extraction unit through line 28 provided they meet the feedstock criteria described previously for raffinate feedstock.

In extraction unit 30, the distillate cuts are solvent extracted with n-methyl pyrrolidone and the extraction unit is preferably operated in countercurrent mode. The solvent-to-oil ratio, extraction temperature and percent water in the solvent are used to control the degree of extraction, i.e., separation into a paraffins rich raffinate and an aromatics rich extract. The present process permits the extraction unit to operate to an "under extraction" mode, i.e., a greater amount of aromatics in the paraffins rich raffinate phase. The aromatics rich extract phase is sent for further processing through line 32. The raffinate phase is conducted through line 34 to solvent stripping unit 36. Stripped solvent is sent through line 38 for recycling and stripped raffinate is conducted through line 40 to first hydroconversion unit 42.

The first hydroconversion unit 42 contains KF-840 catalyst which is nickel/molybdenum on an alumina support and available from Akzo Nobel. Hydrogen is admitted to unit or reactor 42 through line 44. Unit conditions are typically temperatures of from 340–420° C., hydrogen partial pressures from 800 to 2000 psig, space velocity of from 0.5 to 3.0 LHSV and a hydrogen to feed ratio of from 500 to 5000 Scf/B. Gas chromatographic comparisons of the hydroconverted raffinate indicate that almost no wax isomerization is taking place. While not wishing to be bound to any particular theory since the precise mechanism for the VI increase which occurs in this stage is not known with certainty, it is known that heteroatoms are being removed, aromatic rings are being saturated and naphthene rings, particularly multi-ring naphthenes, are selectively eliminated.

Hydroconverted raffinate from unit 42 is sent through line 46 to second unit or reactor 50. Reaction conditions in unit are mild and include a temperature of from 200–320° C., a hydrogen partial pressure of from 800 to 2000 psig, a space velocity of 1 to 5 LHSV and a hydrogen feed rate of from 500 to 5000 Scf/B. This mild or cold hydrofinishing step further reduces toxicity to very low levels.

Hydroconverted raffinate is then conducted through line 52 to separator 54. Light liquid products and gases are separated and removed through line 56. The remaining hydroconverted raffinate is conducted through line 58 to dewaxing unit 60. Dewaxing may occur by the use of solvents (introduced through line 62) which may be followed by cooling, by catalytic dewaxing or by a combination thereof. Catalytic dewaxing involves hydrocracking and/or hydroisomerization as a means to create low pour point lubricant basestocks. Solvent dewaxing with optional cooling separates waxy molecules from the hydroconverted lubricant basestock thereby lowering the pour point. Hydroconverted raffinate is preferably contacted with methyl isobutyl ketone followed by the DILCHILL Dewaxing Process developed by Exxon. This method is well known in the art. Finished lubricant basestock is removed through line 64 and waxy product through line 66.

In the process according to the invention, any waxy components in the feed to extraction unit 30 passes virtually unchanged through the hydroconversion zone and is conducted to dewaxing unit 60 where it may be recovered as product.

Toxicity of the basestock is adjusted in the cold hydrofinishing step. For a given target VI, the toxicity may be adjusted by controlling the temperature and pressure.

The basestocks produced according to the invention have unique properties. The basestocks have excellent volatility/viscosity properties typically observed for basestocks having much higher VI. These and other properties are the result of having multi-ring aromatics selectively removed. The presence of even small amounts of these aromatics can adversely impact properties of basestocks including viscosity, VI, toxicity and color.

The basestocks also have improved Noack volatility when compared to Group II hydrocrackates of the same viscosity. When formulated with conventional additive packages used with passenger car motor oils, the finished oils have excellent oxidation resistance, wear resistance, resistance to high temperature deposits and fuel economy properties as measured by engine test results. The basestocks according to the invention can have other uses such as automatic transmission fluids, agricultural oils, hydraulic fluids, electrical oils, industrial oils, heavy duty engine oils and the like.

The invention is further illustrated by the following non-limiting examples.

EXAMPLE 1

The route to improved volatility at a fixed viscosity is to selectively increase the VI of the base oil. Molecularly this requires that the base oil become relatively richer in isoparaffinic species. They have the highest boiling points at a given viscosity. Mid boiling point can be increased (i.e. volatility decreased) by increasing the cut point on a particular sample, thereby raising viscosity. To maintain viscosity at a given cut width and increase mid boiling point necessarily means that the basestock have fewer clustered rings, either naphthenic or aromatic, and more paraffinic character. Isoparaffins are preferred because they have much higher boiling points for the same viscosity versus naphthenes and aromatic multi-rings. They also have lower melting points than normal paraffins. Most crudes have an inherently high population of clustered rings that separations-based processing alone cannot selectively remove to achieve the quality required for modem passenger car motor oils (PCMO's) (i.e. VI of 110 to 120+) in an acceptable yield.

Thermal diffusion is a technique that can be used for separating hydrocarbon mixtures into molecular types. Although it has been studied and used for over 100 years, no really satisfactory theoretical explanation for the mechanism of thermal diffusion exists. The technique is described in the following literature:

L. Jones and E. C. Milberger., *Industrial and Engineering Chemistry*, p. 2689, December 1953, T. A. Warhall and F. W. Melpolder., *Industrial and Engineering Chemistry*. p. 26, January 1962 and H. A. Harner and M. M. Bellamy, *American Laboratory*, p. 41, January 1972 and references therein.

The thermal diffusion apparatus used in the current application was a batch unit constructed of two concentric stainless steel tubes with an annular spacing between the inner and outer tubes of 0.012 in. The length of the tubes was approximate 6 ft. The sample to be tested is placed in the annular space between the inner and outer concentric tubes. The inner tube had an approximate outer diameter of 0.5 in. Application of this method requires that the inner and outer tubes be maintained at different temperatures. Generally temperatures of 100 to 200° C. for the outer wall and about 65° C. for the inner wall are suitable for most lubricating oil samples. The temperatures are maintained for periods of 3 to 14 days.

While not wishing to be bound to any particular theory, the thermal diffusion technique utilizes diffusion and natural convention, which arises from the temperature gradient established between the inner and outer walls of the concentric tubes. Higher VI molecules diffuse to the hotter wall and rise. Lower VI molecules diffuse to the cooler inner walls and sink. Thus a concentration gradient of different molecular densities (or shapes) is established over a period of days. In order to sample the concentration gradient, sampling ports are approximately equidistantly spaced between the top and bottom of the concentric tubes. Ten is a convenient number of sampling ports.

Two samples of oil basestocks were analyzed by thermal diffusion techniques. The first is a conventional 150N basestock having a 102 VI and prepared by solvent extraction/dewaxing methods. The second is a 112 VI basestock prepared by the raffinate hydroconversion (RHC) process according to the invention from a 100 VI, 250N raffinate. The samples were allowed to sit for 7 days after which samples were removed from sampling ports 1–10 spaced from top to bottom of the thermal diffusion apparatus.

Figure 3:
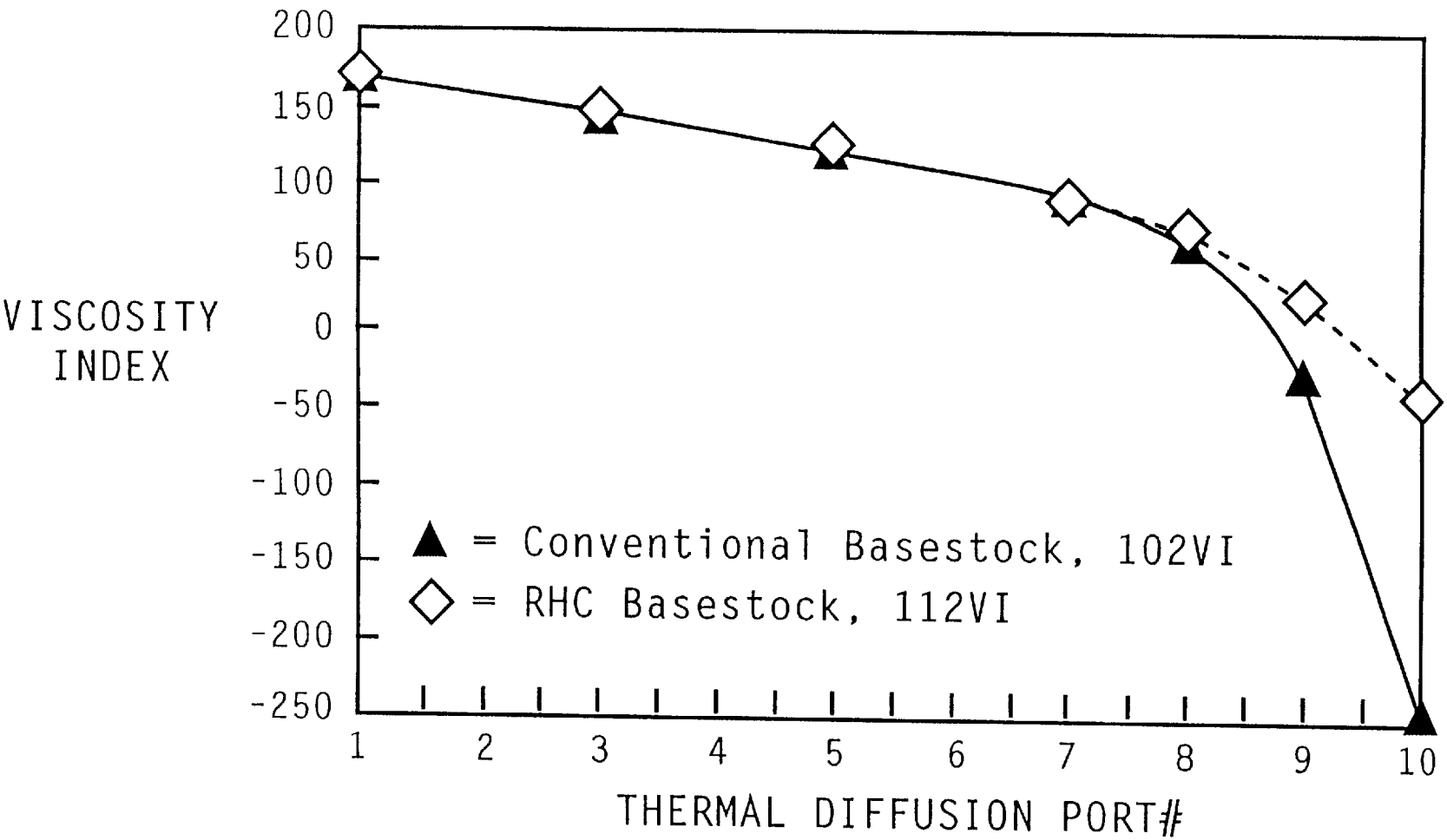
FIG. 3 is a plot of the thermal diffusion separation vs. viscosity index.

The results are shown in FIG. 3. FIG. 3 demonstrates that even a "good" conventional basestock having a 102 VI contains some very undesirable molecules from the standpoint of VI. Thus sampling ports 9 and especially 10 yield molecular fractions containing very low VI's. These fractions which have VI's in the −25 to −250 range likely contain multi-ring naphthenes. In contrast, the RHC product according to the invention contains far fewer multi-ring naphthenes as evidenced by the VI's for products obtained from sampling ports 9 and 10. Thus the present RHC process selectively destroys multi-ring naphthenes and multi-ring aromatics from the feed without affecting the bulk of the other higher quality molecular species. The efficient removal of the undesirable species as typified by port 10 is at least partially responsible for the improvement in NOACK volatility at a given viscosity The excellent properties of basestocks according to invention are given in the following table.

TABLE A

| | Sample Number | |
|---|---|---|
| | I | II |
| Viscosity Index | 116 | 114 |
| Viscosity, @ 100C, cSt | 4.5 | 5.9 |
| Volatility, Noack, wt % | 14 | 8 |
| Pour Point, ° C. | −18 | −18 |
| Saturates by HPLC, wt % | 98 | 97 |

EXAMPLE 2

This example compares a low acidity catalyst useful in the process according to the invention versus a more acidic catalyst. The low acidity catalyst is KF-840 which is commercially available from Akzo Nobel and has an acidity of 0.05. The other catalyst is a more acidic, commercially available catalyst useful in hydrocracking processes having an estimated acidity of 1 and identified as Catalyst A. The feed is a 250N waxy raffinate having an initial boiling point of 335° C., a mid-boiling point of 463° C. and a final boiling point of 576° C., a dewaxed oil viscosity at 100° C. of 8.13 cSt, a dewaxed oil VI of 92 and a pour point of −19° C. The results are shown in Tables 1 and 2.

TABLE 1

Comparison at Similar Conditions

| | Catalyst | |
|---|---|---|
| Operating Conditions | Catalyst A | KF-840 |
| Temperature, ° C. | 355 | 360 |
| LHSV, v/v/hr | 0.5 | 0.5 |
| $H_2$ pressure psig | 800 | 800 |
| $H_2$ to feed Scf/B | 1600 | 1300 |
| Conversion to 370° C.−, wt. % | 22 | 11 |
| Product VI | 114 | 116 |

TABLE 2

Comparison at Similar Conversion

| | Catalyst | |
|---|---|---|
| Operating Conditions | Catalyst A | KF-840 |
| Temperature | 345 | 360 |
| LHSV, v/v/hr | 0.5 | 0.5 |
| $H_2$ pressure psig | 800 | 800 |
| $H_2$ to feed Scf/B | 1600 | 1300 |
| Conversion to 370° C.−, wt. % | 11 | 11 |
| Product VI | 107 | 116 |

As can be seen from Table 1, if reaction conditions are similar, then Catalyst A gives a much higher conversion. If conversion is held constant (by adjusting reaction conditions), then the VI of the product from Catalyst A is much lower. These results show that while more acidic catalysts have higher activity, they have much lower selectivity for VI improvement.

EXAMPLE 3

This example shows that processes like lubes hydrocracking which typically involve a more acid catalyst in the second of two reactors is not the most effective way to improve volatility properties. The results for a 250N raffinate feed having a 100 VI DWO is shown in Table 3. Product was topped to the viscosity required and then dewaxed.

TABLE 3

| 2 Reactor 2 Catalyst* Two Stage Process | | | Raffinate Hydroconversion** | | |
|---|---|---|---|---|---|
| Yield | Viscosity,cSt @ 100° C. | NOACK*** Volatility, wt. % | Yield | Viscosity,cSt @ 100° C. | NOACK Volatility |
| 30.5 | 6.500 | 3.3 | 69.7 | 6.500 | 3.6 |

*1st stage conditions: Ni/Mo catalyst, 360° C., 800 psig $H_2$, 0.5 LHSV, 1200 Scf/B
2nd stage conditions: Ni/Mo/Silica alumina catalyst, 366° C., 2000 psig $H_2$, 1.0 LHSV, 2500 Scf/B
**Conditions: KF-840 catalyst, 353° C., 800 psig $H_2$, 0.49 LHSV, 1200 Scf/B
***Estimated by GCD With an acid silica-alumina type catalyst in the second reactor of the 2 reactor process, the yield of product of a given volatility at the same viscosity is lower than the yield of the process of the invention using raffinate feeds. This confirms that a low acidity catalyst is required to achieve low volatility selectively.

EXAMPLE 4

Many current commercially available basestocks will have difficulty meeting future engine oil volatility requirements. This example demonstrates that conventional extraction techniques vs. hydroconversion techniques suffer from large yield debits in order to decrease NOACK volatility. NOACK volatility was estimated using gas chromatographic distillation (GCD) set forth in ASTM 2887. GCD NOACK values can be correlated with absolute NOACK values measured by other methods such as DIN 51581.

The volatility behavior of conventional basestocks is illustrated using an over-extracted waxy raffinate 100N sample having a GCD NOACK volatility of 27.8 (at 3.816 cSt viscosity at 100° C.). The NOACK volatility can be improved by removing the low boiling front end (Topping) but this increases the viscosity of the material. Another alternative to improving NOACK volatility is by removing material at both the high boiling and low boiling ends of the feed to maintain a constant viscosity (Heart-cut). Both of these options have limits to the NOACK volatility which can be achieved at a given viscosity and they also have significant yield debits associated with them as outlined in the following table;

TABLE 4

Distillation Assay of 100N Over-Extracted Waxy Raffinate (103 VI DWO*)

| Processing | NOACK Volatility, wt. %** | Yield, % | Viscosity, cSt @ 100° C. |
|---|---|---|---|
| None | 27.8 | 100 | 3.816 |
| Topping | 26.2 | 95.2 | 3.900 |
| Heart-cut | 22.7 | 58.0 | 3.900 |
| Heart-cut | 22.4 | 50.8 | 3.900 |
| Heart-cut | 21.7 | 38.0 | 3.900 |

*DWO = dewaxed oil
**estimated by GCD

EXAMPLE 5

The over-extracted feed from Example 4 was subjected to raffinate hydroconversion under the following conditions: KF-840 catalyst at 353° C., 800 psig $H_2$, 0.5 LHSV, 1200 Scf/B. Raffinate hydroconversion under these conditions increased the DWO VI to 111. The results are given in Table 5.

TABLE 5

Distillation Assay of Hydroconverted Waxy Raffinate (103 VI to 111 VI DWO)

| Processing | NOACK* Volatility | Yield, % | Viscosity, cSt @ 100° C. |
|---|---|---|---|
| None | 38.5 | 99.9 | — |
| Topping | 21.1 | 76.2 | 3.900 |
| Heart-cut | 20.9 | 73.8 | 3.900 |
| Heart-cut | 19.9 | 62.8 | 3.900 |
| Heart-cut | 19.2 | 52.2 | 3.900 |
| Heart-cut | 18.7 | 39.6 | 3.900 |

*Estimated by GCD

These results demonstrate that raffinate hydroconversion can achieve lower NOACK volatility much more selectivity than by distillation alone, e.g., more than double the yield at 21 NOACK. Furthermore, since the process of the invention removes poorer molecules, much lower volatilities can be achieved than by distillation alone.

EXAMPLE 6

This example illustrates the preferred feeds for the raffinate hydroconversion (RHC) process. The results given in Table 6 demonstrate that there is an overall yield credit associated with lower VI raffinates to achieve the same product quality (110 VI) after topping and dewaxing. The table illustrates the yields achieved across RHC using 100N raffinate feed.

TABLE 6

| Feed VI | NOACK Volatility | Viscosity cSt @ 100° C. | Extraction Yield | Hydro-processing Yield | Yield of Waxy Product (on distillate) |
|---|---|---|---|---|---|
| 103* | 21.1 | 3.900 | 53.7 | 76.2 | 40.9 |
| 92** | 21.1 | 4.034 | 73.9 | 63.8 | 47.1 |

*KF-840 catalyst, 353° C., 800 psig $H_2$, 0.5 LHSV, 1200 Scf/B
**KF-840 catalyst,, 363–366° C., 1200 psig $H_2$, 0.7 LHSV, 2400 Scf/B The yield to get to a 110 VI product directly from distillate by extraction alone is only 39.1% which further illustrates the need to combine extraction with hydroprocessing.

While under-extracted feeds produce higher yields in RHC, use of distillates as feeds is not preferred since very severe conditions (high temperature and low LHSV) are required. For example, for a 250N distillate over KF-840 at 385° C., 0.26 LHSV, 1200 psi $H_2$, and 2000 Scf/B gas rate, only 104 VI product was produced.

Also, combinations of distillate hydroprocessing (to reach an intermediate VI) then extraction to achieve target VI is not preferred. This is because the extraction process is nonselective for removal of naphthenes created from aromatics in the distillate hydroprocessing stage.

EXAMPLE 7

In the raffinate hydroconversion process according to the invention, the first reaction zone is followed by a second cold hydrofining (CHF) zone. The purpose of CHF is to reduce the concentration of molecular species which contribute to toxicity. Such species may include 4- and 5-ring polynuclear aromatic compounds, e.g., pyrenes which either pass through or are created in the first reaction zone. One of the tests used as an indicator of potential toxicity is the FDA "C" test (21 CFR 178.3620) which is based on absorbances in the ultraviolet (UV) range of the spectrum. The following table demonstrates that CHF produces a product with excellent toxicological properties, which are much lower than the acceptable maximum values.

TABLE 7

| | FDA "C" | | | |
|---|---|---|---|---|
| | 280–289 nm | 290–299 nm | 300–359 nm | 360–400 nm |
| FDA "C" MAX (Absorbance Units) | 0.7 | 0.6 | 0.4 | 0.09 |
| Sample | | | | |
| CHF Products | | | | |
| DLM-120 | 0.42 | 0.25 | 0.22 | 0.024 |
| (CHF Process Conditions: 3 v/v/h, 260° C., 800 psig, 1200 Scf/B Hydrogen (containing N = 38 wppm, S = 0.6 wt. % on feed)) | | | | |
| DLM-118 | 0.26 | 0.14 | 0.11 | 0.013 |
| (CHF Process Conditions: 3 v/v/h, 260° C., 800 psig, 1200 Scf/B Hydrogen) | | | | |
| CHF Products | | | | |
| DLM-115 | 0.36 | 0.23 | 0.17 | 0.016 |
| (CHF Process Conditions: 2 v/v/h, 260° C., 800 psig, 1200 Scf/B) | | | | |

These results demonstrate that a CHF step enables the product to easily pass the FDA "C" test.

EXAMPLE 8

Example 8 shows that products from RHC have outstanding toxicological properties versus basestocks made either by conventional solvent processing or hydrocracking. Besides FDA "C", IP 346 and modified Ames (mutagenicity index) are industry wide measures of toxicity. The results are shown in Table 8.

TABLE 8

| | Commercial Solvent Extracted Basestock | | Commercial Hydrocracked Basestock | RHC Basestock | |
|---|---|---|---|---|---|
| | 100 N | 250 N | 100 N | 100 N | 250 N |
| IP346, wt. % | 0.55 | 0.55 | 0.67 | 0.11 | 0.15 |
| Mod Ames, MI | 0.0 | 0.0 | 0.0 | 0.0 | 0.0 |
| FDA (C) (phase I) (300–359 nm) | 0.22 | 0.22 | 0.21 | 0.02 | 0.03 |

The results in Table 8 demonstrate that RHC produces a basestock with much improved toxicological properties over conventional solvent extracted or hydrocracked basestocks.

EXAMPLE 9

A 250N distillate was extracted with NMP under the conditions set forth in Table 9. Water was added to the NMP solvent at 5 vol. % according to the invention to favor high yield of raffinate and at 0.5 vol. % as a comparative example of typical raffinate under normal extraction conditions.

TABLE 9

Dewaxed (−18° C. Pour) Raffinate Composition: 250N

| Countercurrent Extraction | Example 10 | Comparative Example 10 |
|---|---|---|
| Conditions | | |
| Treat, LV % | 275 | 90 |
| % $H_2O$ in Solvent | 5 | 0.5 |
| Temperature, ° F. (° C.) | 176 (80) | 124 (51) |

TABLE 9-continued

| Dewaxed (−18° C. Pour) Raffinate Composition: 250N | | |
|---|---|---|
| Countercurrent Extraction | Example 10 | Comparative Example 10 |
| (Bottom) Gradient, F | 11 | 11 |
| Yield, LV % | 66 | 61 |
| Quality | 97 | 97 |
| VI | | |
| Composition, LV % | | |
| Saturates | | |
| 0 − R | 24 | 22 |
| 1 − R | 15 | 13 |
| 2 − R | 11 | 11 |
| 3 − R | 9 | 11 |
| 4 − R | 5 | 7 |
| 5 + R | 2 | 2 |
| Total Saturates | 66 | 66 |
| Aromatics | | |
| 1 − R | 18 | 18 |
| 2 − R | 3 | 3 |
| 3 − R | 1 | 1 |
| 4 − R | 0.5 | 0.5 |
| 5 − R | 0.5 | 0.5 |
| Thiopheno | 4 | 4 |
| Total Aromatics | 27 | 27 |
| Unidentified | 7 | 7 |

The data demonstrate that the raffinate according to the invention extracted with NMP containing 5 LV % water provides a superior feed to the first hydroconversion unit. The raffinate feed results in about 5 LV % more yield (at 97 VI) and about 4 LV % more paraffin plus 1-ringnaphthenes and about 4 LV % less 3+ ring naphthenes.

Based on the data in Table 9, RHC feed should be extracted at low severity to target a maximum of 3+ ring compounds (aromatics and naphthenes) rather that to target VI. The highest yield of such raffinate will be obtained using high water/high treat extraction conditions. Optimization of extraction could provide 5 LV % or more of waxy raffinate which can be fed to the hydroconversion process without any process debits.

EXAMPLE 10

Figure 4:
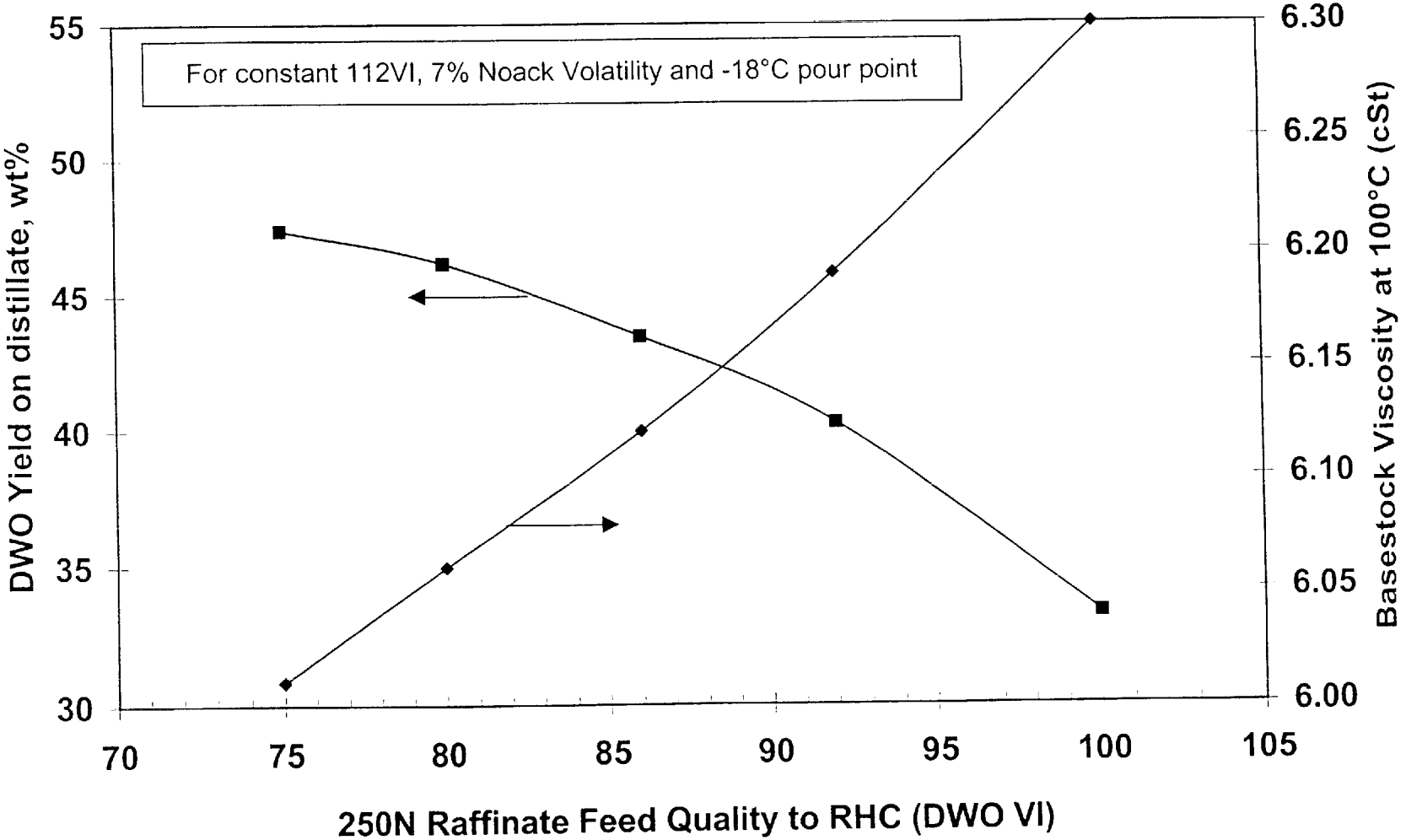
FIG. 4 is a graph showing raffinate feed quality as a function of dewaxed oil yield and basestock viscosity.

A unique feature of the products from the present process is that both yield and the crucial volatility/viscosity properties are improved by using under-extracted feeds. In other processes, yield improvements are generally at the expense of basestock quality. FIG. 4 is a graph illustrating the raffinate feed quality as a function of yield and viscosity. A 250N distillate was extracted, hydroprocessed, vacuum stripped and dewaxed to produce a constant VI (113), 7.0% NOACK volatility basestock with a −18° C. pour point. As shown in FIG. 4, preferred feeds have a DWO VI between about 80 to about 95.

EXAMPLE 11

Figure 5:
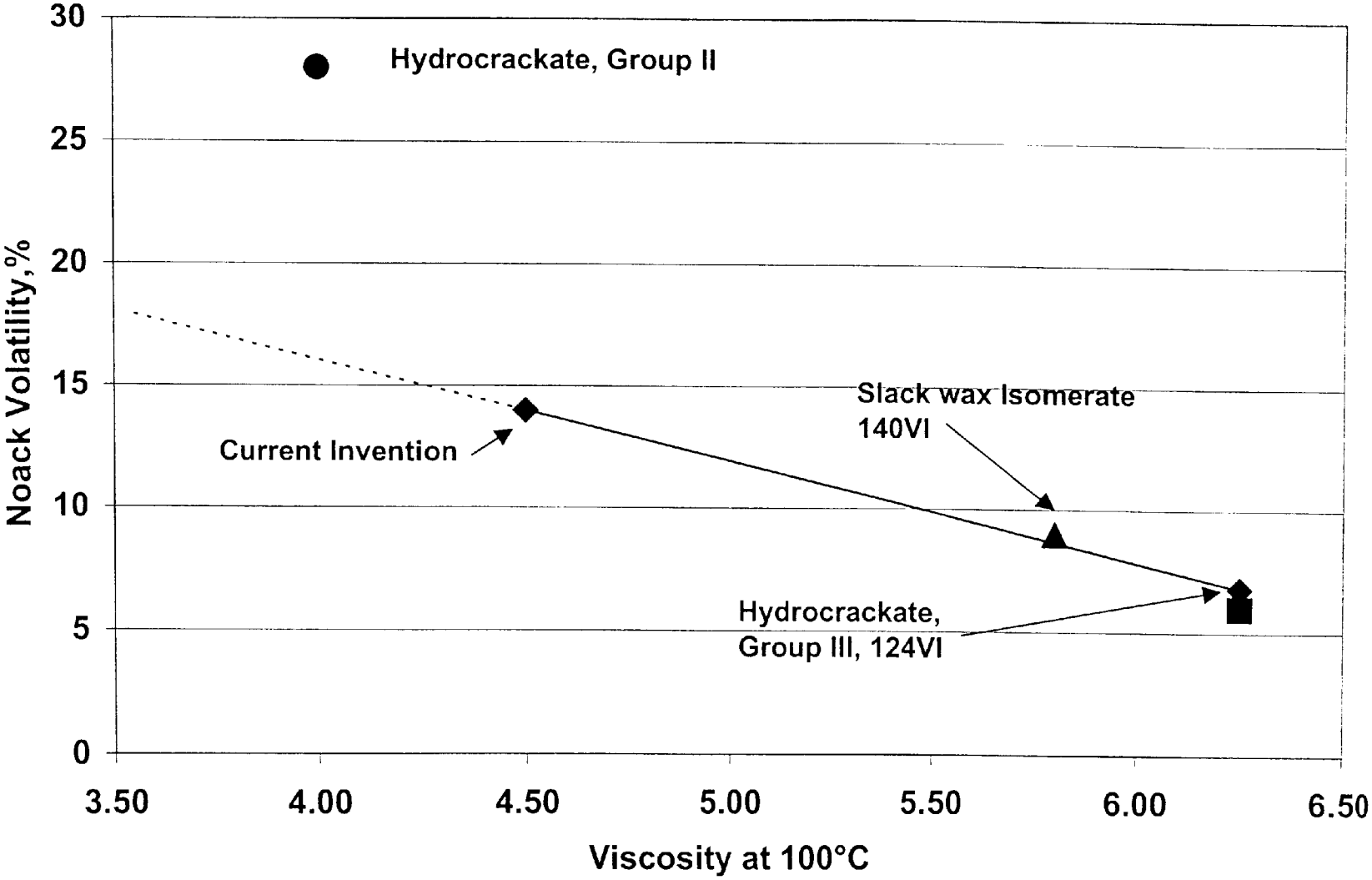
FIG. 5 is a graph showing viscosity vs. Noack volatility for different basestocks.

FIG. 5 illustrates that the Group II products from the current invention most closely follow the volatility-viscosity relationship of Group III basestocks (having much higher VI's). The Figure also compares this behavior with the much poorer volatility-viscosity relationship of a standard Group II hydrocrackate. The basestocks of the invention have unique properties in that they have VI <120 and yet have viscosity/volatility properties comparable to Group III basestocks (>120 VI). Those basestocks characterized as having viscosities in the range 3.5 to 6.0 cSt at 100° C. are defined by the equation N=(32−(4)(viscosity at 100° C.))±1 where N is the Noack volatility.

Figure 6:
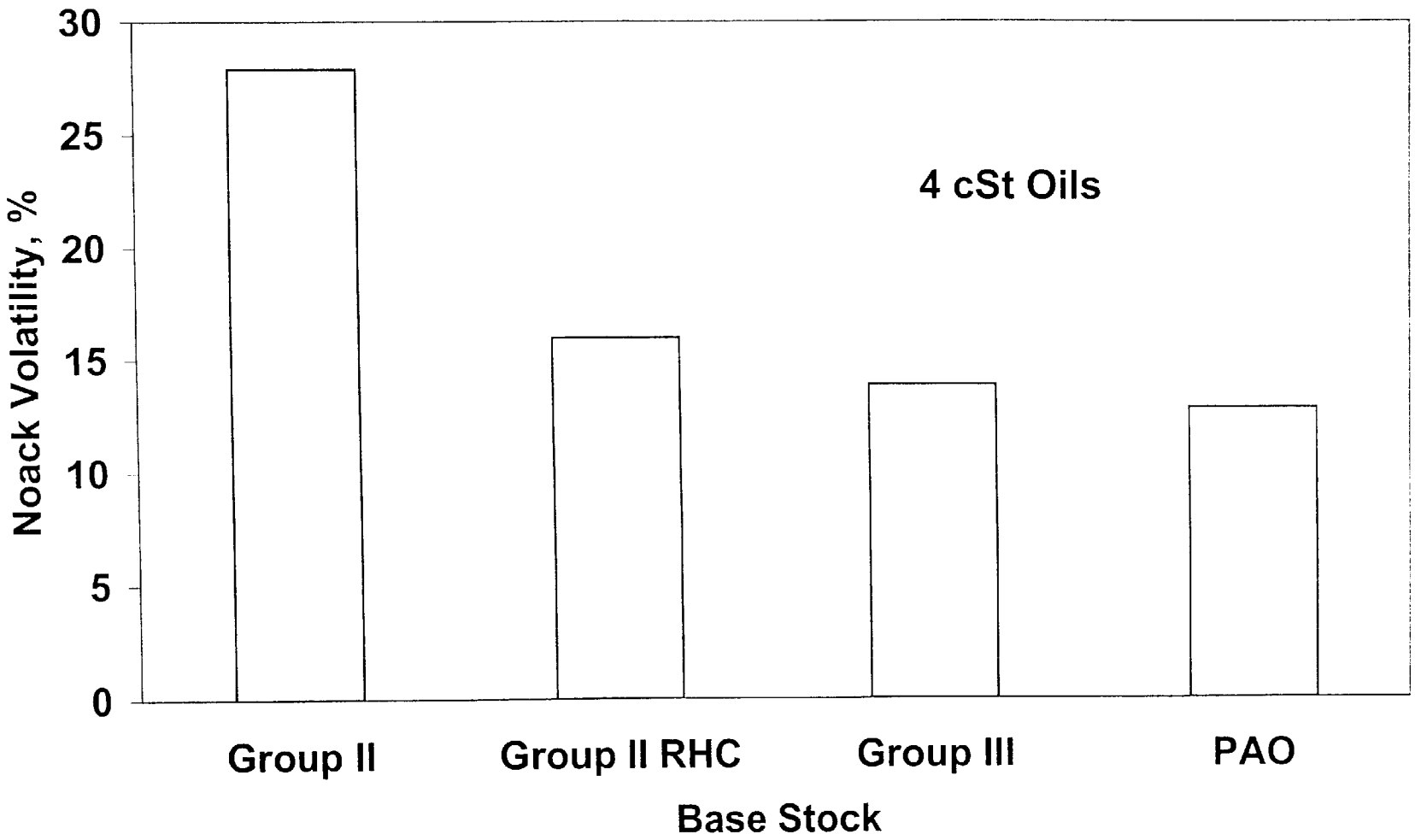
FIG. 6 is a graph showing Noack volatility vs. basestock type.

FIG. 6 shows that the Group II basestock according to the invention has a superior Noack volatility compared to the conventional Group II basestock based on 4 cSt oils.

EXAMPLE 12

It is well known that basestock quality can affect finished oil performance in certain standard industry tests. The performance of the present basestocks in fully formulated GF-2 type 5W-30 formulations was therefore assessed in both bench and sequence engine tests.

An in-house bench oxidation test was first used to assess the resistance to oxidative thickening offered by the present basestocks compared to conventionally processed Group I stocks. The test oil is subjected to air sparging in the presence of a soluble iron catalyst at 165° C.; the change in 40° C. kinematic viscosity with time is recorded and an estimate of the hours to reach 375% viscosity increase is made. Two different additive systems were compared in the conventional Group I and in the present basestocks (designated as "EHC") in Table 10 below:

TABLE 10

| Blend Number: | 1 | 2 | 3 | 4 |
|---|---|---|---|---|
| Performance Additive System | A | B | A | B |
| Basestocks | Group I | Group I | EHC | EHC |
| Oxidation Screener, est. hrs to 375% vis. increase | 57.5 | 82.5 | 72.0 | 83.5 |

Additive systems A and B are conventional additive packages. Additive system A includes a detergent, dispersant, antioxidant, friction modifier, demulsifier, VI improver and antifoamant. Additive system B includes a detergent, dispersant, antioxidant, friction modifier, antifoamant and VI improver. The individual components within each additive package may vary according to the manufacturer. The basestocks according to the invention were found to provide significant improvement in oxidation performance over the conventional basestock with additive system 'A', and somewhat smaller improvement with additive system 'B'.

The oxidation screener can only provide a general indication of oxidation resistance. To confirm engine performance, Sequence IIIE tests were conducted on the Group I and on the EHC stocks in 5W-30 formulations using additive system 'B'. The Sequence IIIE test is a standard industry bench engine test which assesses oxidation resistance, wear and high temperature deposits (ASTM D 5533). The results, shown in Table 11, indicated that the EHC basestocks provided improved oxidation control (beyond that predicted in the bench screener), as well as good control of high temperature deposits.

TABLE 11

| | Blend Number: | | |
|---|---|---|---|
| | 5 | 6 | Limits |
| Performance Additive System | B | B | |
| Basestocks | Group I | EHC | |

TABLE 11-continued

| | Blend Number: 5 | 6 | Limits |
|---|---|---|---|
| Seq. IIIE | | | |
| % Viscosity Increase @ 64 hr | 182 | 63 | 375 max |
| Hours to 375% vis. Increase | 71.2 | 78.9 | 64 min |
| Avg. Engine Sludge, merits | 9.57 | 9.51 | 9.2 min |
| Avg. Piston Skirt Varnish, merits | 9.31 | 9.17 | 8.9 min |
| Oil Ring Land Deposits, merits | 3.02 | 3.96 | 3.5 min |
| Stuck Lifters | none | none | none |
| Scuffed/Worn Cam or Lifters | none | none | none |
| Avg. Cam + Lifter Wear, microns | 15.4 | 9 | 30 |
| Max. Cam + Lifter Wear, microns | 74 | 20 | 64 |
| Oil Consumption, L | 3.85 | 2.55 | Report |

Figure 7:
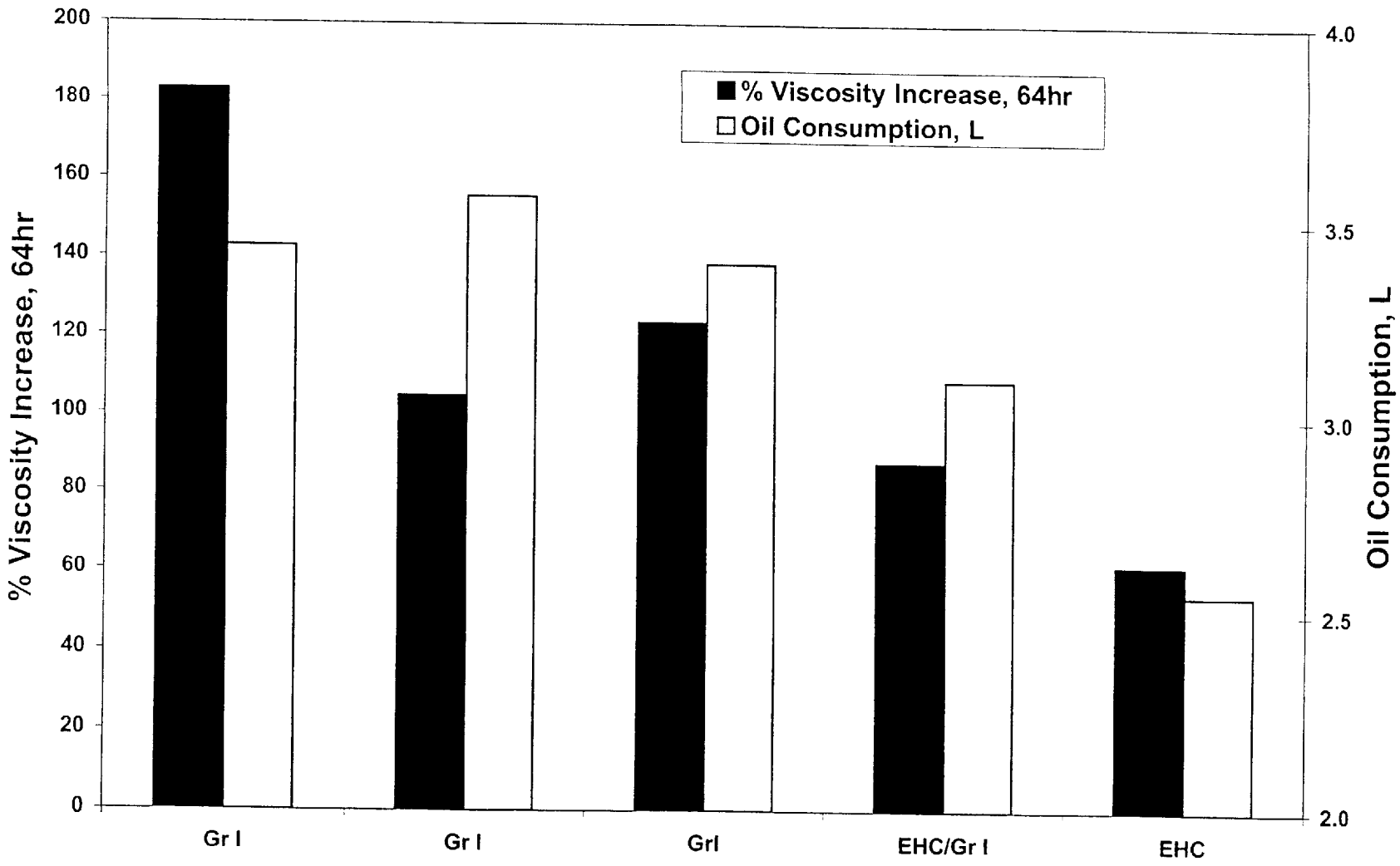
FIG. 7 is a graph showing percent viscosity increase and oil consumption as a function of basestock type.

Repeat IIIE testing on the Group I, 5W-30, showed that this additive system could meet the wear and ring land deposit requirements in conventionally refined stocks. However, viscosity increase remained better for the EHC formulations, either alone, or in combination with Group I basestocks as shown in FIG. 7. Oil consumption was also consistently lower for the EHC formulation, probably due to the lower volatility of these basestocks.

EXAMPLE 14

The Sequence VE is another key engine test which measures sludge, varnish and wear under relatively low engine operating temperatures. Comparative tests were conducted on SAE 5W-30 formulations made with Group I and with EHC stocks in another additive system. These indicated that the EHC basestocks provided at least as good control of sludge and better average varnish than the conventional stock (Table 12).

TABLE 12

| | Blend Number: 7 | 8 | Limits |
|---|---|---|---|
| Performance Additive System | C | C | |
| Basestocks | Group I | EHC | |
| Seq. VE | | | |
| Avg. Engine Sludge, merits | 9.14 | 9.49 | 9.0 min |
| Rocker Cover Sludge, merits | 8.28 | 9.04 | 7.0 min |
| Piston Skirt Varnish, merits | 7.02 | 6.90 | 6.5 min |
| Avg. Engine Varnish, merits | 5.43 | 6.25 | 5.0 min |
| Oil Screen Clogging, % | 3 | 0 | 20 max |
| Hot Stuck Rings | none | none | none |
| Avg. Cam Wear, microns | 83.6 | 18 | 130 max |
| Max. Cam Wear, microns | 231 | 27 | 380 max |

EXAMPLE 15

Lubricant fuel economy and fuel economy retention has become of increasing importance to original equipment manufacturers, and this is reflected in the greater demands of standard industry tests. Proposed Sequence VIB fuel economy limits from the draft ILSAC GF-3 specification are shown in Table 13 10 along with single test results on SAE 5W-20, 5W-30 and 1OW-30 prototype formulations containing EHC basestocks and a single additive system. It is apparent that the EHC stocks offer the potential to meet these very demanding limits.

TABLE 13

| | | Originally Proposed Limits |
|---|---|---|
| Performance Additive System | D | |
| Basestocks | EHC | |
| 5W-20 | | |
| 16 hr, % Fuel Economy Improvement | 2.0 | 2.0 min |
| 96 hr, % Fuel Economy Improvement | 1.8 | 1.7 min |
| 5W-30 | | |
| 16 hr, % Fuel Economy Improvement | 1.7 | 1.7 min |
| 96 hr, % Fuel Economy Improvement | 1.4 | 1.4 min |
| 10W-30 | | |
| 16 hr, % Fuel Economy Improvement | 1.4* | 1.3 min |
| 96 hr, % Fuel Economy Improvement | 1.1* | 1.0 min |

*referenced engine stand, latest Sequence VIB industry Severity Bias Correction Factors applied.

What is claimed is:

1. A process for producing a lubricating oil basestock which comprises:

(a) conducting a lubricating oil feedstock, said feedstock being a distillate fraction, to a solvent extraction zone and under-extracting the feedstock to form an under-extracted raffinate wherein the extraction zone solvent contains water added in the amount from about 1 to about 10 vol. %, based on extraction solvent, such that the extraction solvent contains from 3 to 10 vol. % water;

(b) stripping the under-extracted raffinate of solvent to produce an under-extracted raffinate feed having a dewaxed oil viscosity index from about 75 to about 105;

(c) passing the raffinate feed to a first hydroconversion zone and processing the raffinate feed in the presence of a non-acidic catalyst at a temperature of from about 320 to about 420° C., a hydrogen partial pressure of from about 800 to about 2500 psig, space velocity of about 0.2 to about 5.0 LHSV, and a hydrogen to feed ratio of from about 500 to about 5000 Scf/B to produce a first hydroconverted raffinate; and (d) passing the first hydroconverted raffinate to a second reaction zone and conducting cold hydrofinishing of the first hydroconverted raffinate in the presence of a hydrofinishing catalyst at a temperature of from about 200 to about 360° C., a hydrogen partial pressure of from about 800 to about 2500 psig, a space velocity of from about 1 to about 10 LHSV, and a hydrogen to feed ratio of from about 500 to about 5000 Scf/B to produce a hydrofinished raffinate.

2. The process of claim 1 wherein the solvent extraction zone includes an extraction solvent selected from at least one of N-methyl-2-pyrrolidone, furfural and phenol.

3. The process of claim 2 wherein the extraction zone conditions include a solvent: oil ratio is from 0.5 to 5.0.

4. The process of claim 1 wherein the raffinate feed has a dewaxed oil viscosity index from about 80 to about 95.

5. The process of claim 1 wherein the non-acidic catalyst has an acidity less than about 0.5, said acidity being determined by the ability of the catalyst to convert 2-methyl-2-pentene to 3-methyl-2-pentene and 4-methyl-2-pentene and is expressed as the mole ratio of 3-methyl-2-pentene to 4-methyl-2-pentene.

6. The process of claim 1 wherein the non-acidic catalyst in the first hydroconversion zone is at least one of a Group VIB metal and non-noble Group VIII metal.

7. The process of claim 1 wherein the space velocity in the first hydroconversion zones is from about 0.3 to 3.0 LHSV.

8. The process of claim 1 wherein the temperature in the hydrofinishing zone is from about 290 to 350° C.

9. The process of claim 1 wherein the catalyst in the hydrofinishing zone includes at least one Group VIII noble metal.

10. The process of claim 9 wherein the catalyst is Pt, Pd or a mixture thereof.

11. The process of claim 1 wherein the first hydroconverted raffinate is passed to a separator to separate low boiling products from hydroconverted raffinate prior to passing to the hydrofinishing reaction zone.

12. The process of claim 11 wherein hydroconverted raffinate from the separator is passed to a dewaxing zone and subjected to at least one of solvent dewaxing and catalytic dewaxing prior to passing to the hydrofinishing zone.

13. The process of claim 12 wherein catalytic dewaxing is accomplished with a dewaxing catalyst containing at least one 10 ring molecular sieve.

14. The process of claim 1 wherein the first hydroconverted raffinate is passed to a dewaxing zone and catalytically dewaxed using a sulfur and nitrogen tolerant molecular sieve prior to passing to the hydrofinishing zone.

15. The process of claim 1 wherein the hydrofinished raffinate is passed to a separator to separate low boiling products from the hydrofinished raffinate to produce a second hydrofinished raffinate.

16. The process of claim 15 wherein the second hydrofinished raffinate is passed to a dewaxing zone and subjected to at least one of solvent dewaxing and catalytic dewaxing to produce a dewaxed second hydrofinished raffinate.

17. The process of claim 16 wherein the catalytic dewaxing is accomplished with a dewaxing catalyst containing at least one 10 ring molecular sieve.

18. The process of claim 1 wherein the hydrofinished raffinate is passed to a dewaxing zone and dewaxed using a sulfur and nitrogen tolerant molecular sieve.

19. The process of claim 16 wherein the dewaxed second hydrofinished raffinate is further hydrofinished in a second hydrofinishing zone.

20. The process of claim 1 wherein the under-extracted raffinate feed is solvent dewaxed under solvent dewaxing conditions prior to entering the first hydroconversion zone.

21. The process of claim 1 additionally comprising adding additives to the lubricating oil basestock.

22. The process of claim 21 wherein the additives comprise at least one detergent, dispersant, antioxidant, friction modifier, demulsifier, VI improver and antifoamant.

23. The process of claim 1 wherein first hydroconversion zone additionally contains a catalytic dewaxing catalyst.

24. A process for producing a lubricating oil basestock which comprises:

(a) conducting a lubricating oil feedstock, said feedstock being a distillate fraction, to a solvent extraction zone and under-extracting the feedstock to form an under-extracted raffinate wherein the extraction zone solvent contains water added in the amount from about 1 to about 10 vol. %, based on extraction solvent, such that the extraction solvent contains from 3 to 10 vol. % water;

(b) stripping the under-extracted raffinate of solvent to produce an under-extracted raffinate feed having a dewaxed oil viscosity index from about 75 to about 105;

(c) passing the raffinate feed to a first hydroconversion zone and processing the raffinate feed in the presence of a non-acidic catalyst at a temperature of from about 320 to about 420° C., a hydrogen partial pressure of from about 800 to about 2500 psig, space velocity of about 0.2 to about 5.0 LHSV, and a hydrogen to feed ratio of from about 500 to about 5000 Scf/B to produce a first hydroconverted raffinate;

(d) passing at least a portion of the first hydroconverted raffinate to a dewaxing zone and conducting at least one of catalytic and solvent dewaxing under dewaxing conditions to produce a dewaxed hydroconverted raffinate; and (e) passing the dewaxed hydroconverted raffinate to a second reaction zone and conducting cold hydrofinishing of the first hydroconverted raffinate in the presence of a hydrofinishing catalyst at a temperature of from about 200 to about 360° C., a hydrogen partial pressure of from about 800 to about 2500 psig, a space velocity of from about 1 to about 10 LHSV, and a hydrogen to feed ratio of from about 500 to about 5000 Scf/B to produce a hydrofinished raffinate.

* * * * *

UNITED STATES PATENT AND TRADEMARK OFFICE

CERTIFICATE OF CORRECTION

PATENT NO. : 6,592,748 B2
DATED : July 15, 2003
INVENTOR(S) : Ian A. Cody et al.

It is certified that error appears in the above-identified patent and that said Letters Patent is hereby corrected as shown below:

Title page, Item [54] and Column 1, line 1,
Title, is corrected to read -- RAFFINATE HYDROCONVERSION PROCESS -- instead of "REFFINATE HYDROCONVERSION PROCESS".

Signed and Sealed this

Twenty-first Day of December, 2004

JON W. DUDAS
*Director of the United States Patent and Trademark Office*